US010443174B2

(12) United States Patent
Wen

(10) Patent No.: US 10,443,174 B2
(45) Date of Patent: Oct. 15, 2019

(54) DYEING MACHINE WITH SYMMETRICAL DOUBLE SPIRAL FABRIC TANKS

(71) Applicant: Pi-Hsin Wen, Taoyuan (TW)

(72) Inventor: Pi-Hsin Wen, Taoyuan (TW)

( * ) Notice: Subject to any disclaimer, the term of this patent is extended or adjusted under 35 U.S.C. 154(b) by 192 days.

(21) Appl. No.: 15/722,237

(22) Filed: Oct. 2, 2017

(65) Prior Publication Data

US 2018/0148875 A1 May 31, 2018

(30) Foreign Application Priority Data

Nov. 30, 2016 (TW) ..... 105139433 A

(51) Int. Cl.

| | |
|---|---|
| ***D06B 3/36*** | (2006.01) |
| ***D06B 23/02*** | (2006.01) |
| ***D06B 23/04*** | (2006.01) |
| ***D06B 23/22*** | (2006.01) |
| ***D06B 3/28*** | (2006.01) |
| ***D06B 23/14*** | (2006.01) |
| ***D06B 1/08*** | (2006.01) |

(52) U.S. Cl.

CPC ..... *D06B 3/36* (2013.01); *D06B 3/28* (2013.01); *D06B 23/02* (2013.01); *D06B 23/04* (2013.01); *D06B 23/14* (2013.01); *D06B 23/22* (2013.01); *D06B 1/08* (2013.01); *D06B 2700/36* (2013.01)

(58) Field of Classification Search

CPC ..... D06B 23/02; D06B 23/03; D06B 23/14; D06B 23/22; D06B 3/28; D06B 3/36; D06B 1/08; D06B 2700/36

See application file for complete search history.

(56) References Cited

U.S. PATENT DOCUMENTS 4,165,548 A * 8/1979 Schuierer ..... D06B 3/26 68/176
4,236,392 A * 12/1980 Sando ..... D06B 3/105 68/5 E
4,881,384 A * 11/1989 Chicharro ..... D06B 3/28 68/27
5,469,720 A * 11/1995 Paggi ..... D06B 3/28 226/118.1
6,474,110 B1 * 11/2002 Kurschatke ..... D06B 17/00 68/5 E

FOREIGN PATENT DOCUMENTS

GB 2092190 A * 8/1982 ..... D06B 3/32
TW M720655 U * 11/2013 ..... D06B 23/00

* cited by examiner

*Primary Examiner* — Joseph L. Perrin
(74) *Attorney, Agent, or Firm* — Rosenberg, Klein & Lee

(57) ABSTRACT

A dyeing machine with symmetrical double spiral fabric tanks includes a barrel body with a fabric inlet, two spiral fabric tanks arranged side by side with each other in the barrel body and installed on both sides of the fabric inlet respectively, and each spiral fabric tank having a fabric guiding tube, a spiral fabric sliding plate and a receiving tank. The two fabric guiding tubes are disposed proximate to adjacent sides and facing to the front side and arranged symmetrically with respect to the left and right sides. The two spiral fabric sliding plates are coupled to the rear end of the two fabric guiding tubes and configured to be spirally from top to bottom, so that cloths can be dipped and dyed in the two spiral fabric tanks.

6 Claims, 15 Drawing Sheets

DYEING MACHINE WITH SYMMETRICAL DOUBLE SPIRAL FABRIC TANKS

BACKGROUND OF THE INVENTION

1. Field of the Invention

The present invention generally relates to dyeing machines, in particular to a dyeing machine with no fabric carrying roller installed in a barrel body, and having two spiral fabric tank symmetrically mounted onto the barrel body to form the dyeing machine with double spiral fabric tanks.

2. Description of the Related Art

With reference to FIG. 1 for a schematic view of a conventional O-shaped body dyeing machine 100, the O-shaped body dyeing machine 100 comprises: a barrel body 110, substantially in an O-shaped body, and having a fabric inlet 111 for feeding or removing a cloth 115; an U-shaped fabric storage tank 112, combined into the barrel body 110; a fabric carrying roller 113, installed above the U-shaped fabric storage tank 112; a nozzle 114, installed at the rear of the fabric carrying roller 113, and the fabric carrying roller 113 being provided for lifting and inputting the cloth 115 in the U-shaped fabric storage tank 112 into the nozzle 114; and a dyeing solution input device 116, for inputting a dyeing solution to the nozzle 114, so that the cloth 115 may be dipped and dyed sequentially in the U-shaped fabric storage tank 112.

However, the barrel body 110 and the U-shaped fabric storage tank 112 are integrally combined, so that the volume of the U-shaped fabric storage tank 112 cannot be adjusted according to the volume of the cloth 115, and the type of the cloth 115 is limited. In other words, the U-shaped fabric storage tank 112 is not applicable for the dyeing operation of various different types of cloths 115, and the level (h1) of the dyeing solution (L) has to be almost half of the height of the barrel body 110, so that a low bath ratio or the effects of saving energy and cost cannot be achieved. In addition, the fabric carrying roller 113 cannot be synchronized with the speed of the nozzle 114, so that if the speed of the fabric carrying roller 113 is greater than that could be handled by the nozzle 114, the cloth will be jammed at the inlet of the nozzle 114, and if the maximum speed handled by the nozzle 114 is greater than the speed of the fabric carrying roller 113, the cloth will be rubbed with the fabric carrying roller 113 to produce wrinkles, and affect the quality and texture of the cloth.

Further, a spiral dyeing machine as disclosed in R.O.C. Pat. No. M466123 comprises a fabric storage tank substantially a hollow body and installed in a barrel, and having an opening formed at the top and a plurality of through holes formed on the, peripheral wall of the fabric storage tank, and an outlet formed at the periphery proximate to the bottom of the fabric storage tank; a spiral body installed in the fabric storage tank and configured to be spiral from top to bottom, and the utmost bottom end being coupled to the outlet; a nozzle installed above the fabric storage tank for guiding the cloth to the top of the fabric storage tank, so that the cloth can be dipped and dyed spirally along the spiral body.

However, the aforementioned spiral body cannot be installed into the fabric storage tank easily, and the fabric storage tank is a hollow body, so that a crane is required for hoisting the fabric storage tank for repair and maintenance, and the application is very inconvenient. In addition, a fabric storage tank requires a corresponding cloth access door and a corresponding cloth output roller, but the coefficient of safety will be lowered and the cost will be increased with the number of cloth access doors. In addition, the operation of a dyeing machine with many cloth access doors is inconvenient, and the length of each nozzle pipeline various, and the pressure is non-uniform. Obviously, the conventional dyeing machine requires improvement.

SUMMARY OF THE INVENTION

Therefore, it is a primary objective of the present invention to overcome the drawbacks of the prior art by providing a dyeing machine with symmetrical double spiral fabric tanks, wherein the space for accommodating the cloth is increased, so that the cloth can be arranged smoothly to reduce or eliminate them from tangling or jamming the machine, so as to achieve the effects of improving the low bath ratio and saving energy Another objective of the present invention is to provide a dyeing machine with two spiral fabric tanks installed in a barrel body and without any fabric carrying roller, so as to lower the investment cost and improve the texture of the dyed fabric and the production efficiency.

A further objective of the present invention is to provide a dyeing machine that allows users to adjust the volume of a spiral fabric tank as needed to improve, the equipment performance of the dyeing machine.

To achieve the aforementioned and other objectives, the present invention provides a dyeing machine with symmetrical double spiral fabric tanks, and the dyeing machine comprises: a barrel body, being in a transversal form, and one of the left and right sides being opened, and having a sealed cover with a periphery secured onto the opening to seal the barrel body, and the front side of the barrel body further having a fabric inlet; first and second spiral fabric tanks, configured side by side with each other in the barrel body, and installed on both sides of the fabric inlet respectively, and each of the first and second spiral fabric tank comprising: a hollow tube, a spiral fabric sliding plate installed at the outer periphery of the hollow tube, a ring-shaped baffle covered onto the outer periphery of the spiral fabric sliding plate, a fabric guiding tube installed at an upper front edge of the spiral fabric sliding plate, and a receiving tank installed at a lower front edge of the spiral fabric sliding plate, and having a plurality of through holes formed on the peripheral wall of the receiving thank, wherein one fabric guiding tubes of the first and second spiral fabric tank is installed on the right side, and the other fabric guiding tube is installed on the left side, so as to form two fabric guiding tubes proximate to two adjacent sides and facing to the front, and substantially symmetrical with each other respect to the left and right sides each other, and the spiral fabric sliding plates of the first and second spiral fabric tank are coupled to the rear end of the fabric guiding tube and configured to be in spirally downward form, and one of the first and second spiral fabric tanks is set to be counter-clockwise, the other one is set to be clockwise;

two carrier stages, installed under the first and second spiral fabric tanks respectively, and each carrier stage having a plurality of meshes formed at a stage top of the carrier stage and four symmetrical four guiding wheels, and two parallel rails installed at the lower end of the inner edge of the barrel body and configured to be corresponsive to the guiding wheels respectively, so that the first and second spiral fabric tank can push the barrel body by the carrier stage for repair and maintenance; a dyeing solution input mechanism and a dye injection mechanism for resupplying a dyeing solution, installed outside the barrel body, and the dyeing solution input mechanism having an outlet pipeline, an inlet pipeline and a pump; at least one heat exchanger, installed under the carrier stage, for heating and cooling the dyeing solution in the barrel body;

two first nozzle, coupled to an inlet end of the fabric guiding tube, and coupled to an outlet pipeline of the dyeing solution input mechanism by a pipeline, so that the pressurized dyeing solution delivers the cloth in the receiving tank to the fabric guiding tube and the spiral fabric sliding plate, and the cloth is dipped and dyed in the first and second spiral fabric tank repeatedly in a cycle; and a control mechanism, for controlling the heat exchanger for heating and cooling the dyeing solution in a dyeing process.

In summation, the present invention has the following advantages and effects:

(1) Each of the first and second spiral fabric tanks in the barrel body has a fabric guiding tube, a spiral fabric sliding plate, and a receiving tank, so that the space for accommodating the cloth can be expanded, and the cloth can be arranged smoothly to reduce or prevent the machine from jammed, and the invention also achieves a low bath ratio and the effect of saving energy.

(2) The barrel body has no fabric carrying roller therein, so that the requirement for synchronizing the speed of the nozzle with the speed of the fabric carrying roller in order to maintain the quality and texture of the fabric dyeing no longer exists. Since the dyeing solution input mechanism can supply the dyeing solution for two spiral fabric tanks at the same time, so that an operator can simultaneously monitors the dyeing operation of two cloths. The mechanism of the present invention can reduce the equipment cost and improve the production efficiency.

In the present invention, the spiral fabric tank and the barrel body are independent modules, so that the volume of the spiral fabric tank can be adjusted according to the type and property of the cloths, so as to achieve the effect of enhancing the equipment performance.

DETAILED DESCRIPTION OF THE PREFERRED EMBODIMENT

The above and other objects, features and advantages of this disclosure will become apparent from the following detailed description taken with the accompanying drawings.

Figure 1:
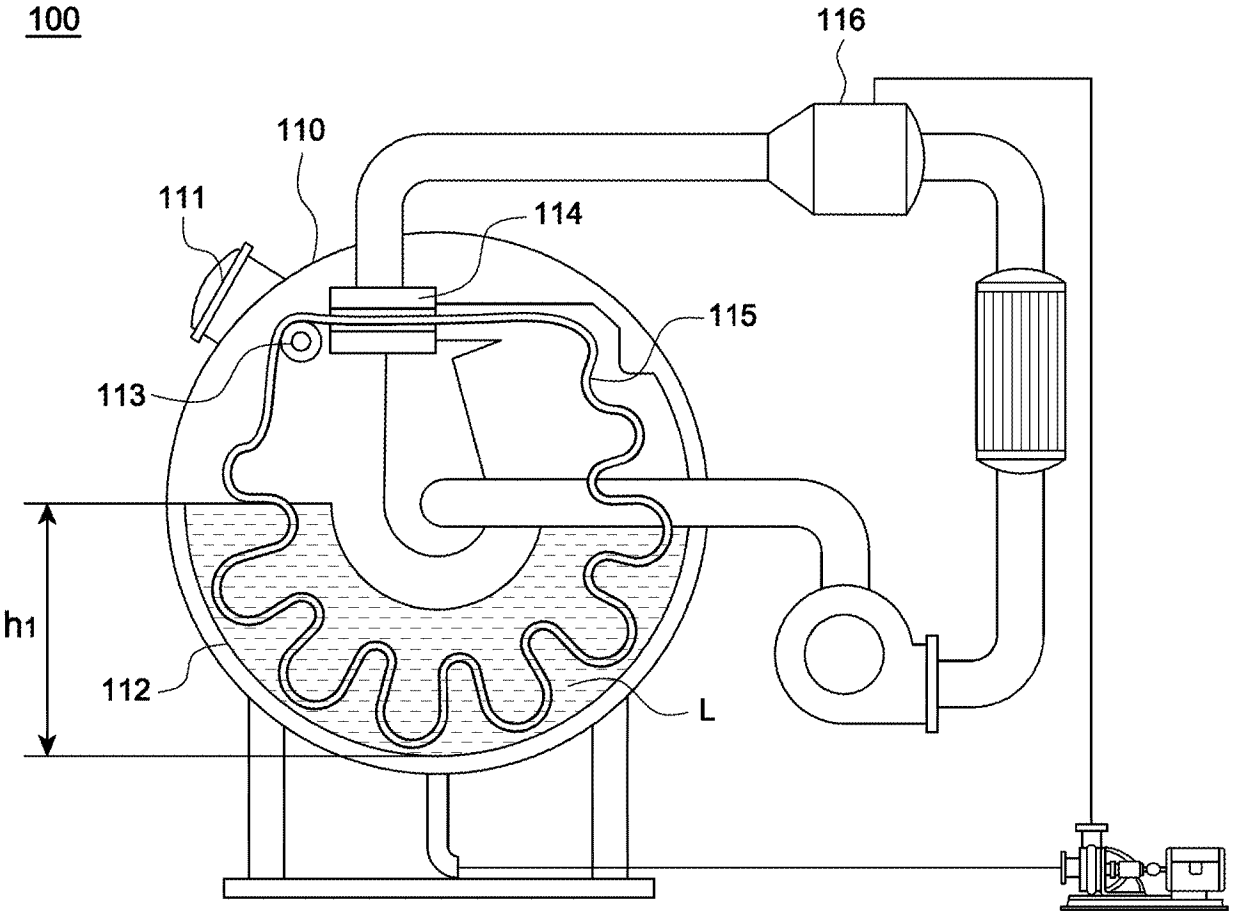
FIG.1 PRIOR ART
FIG. 1 is a schematic view of a conventional O-shaped body dyeing machine.
Figure 2:
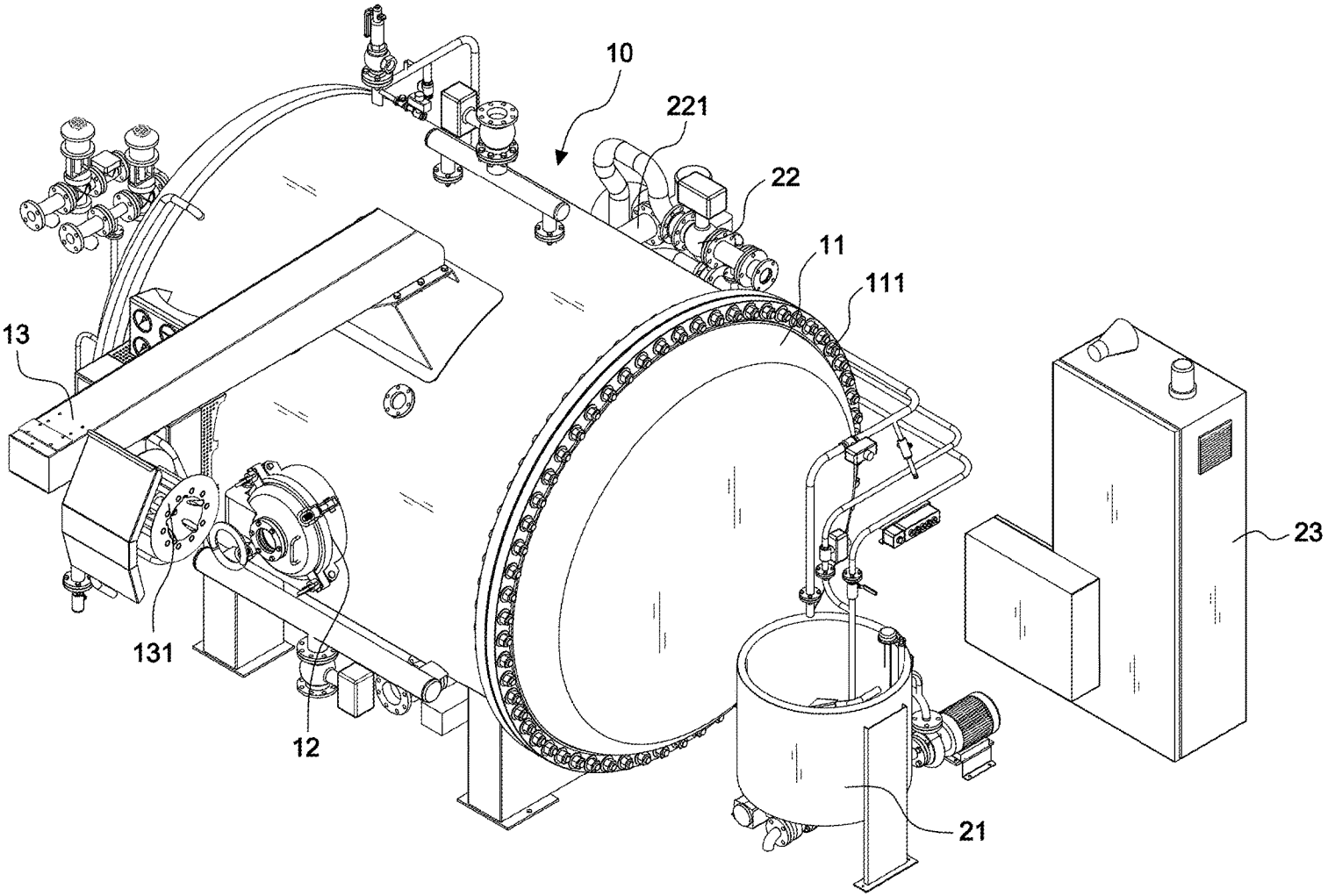
FIG. 2 is a perspective view of the present invention.
Figure 3A:
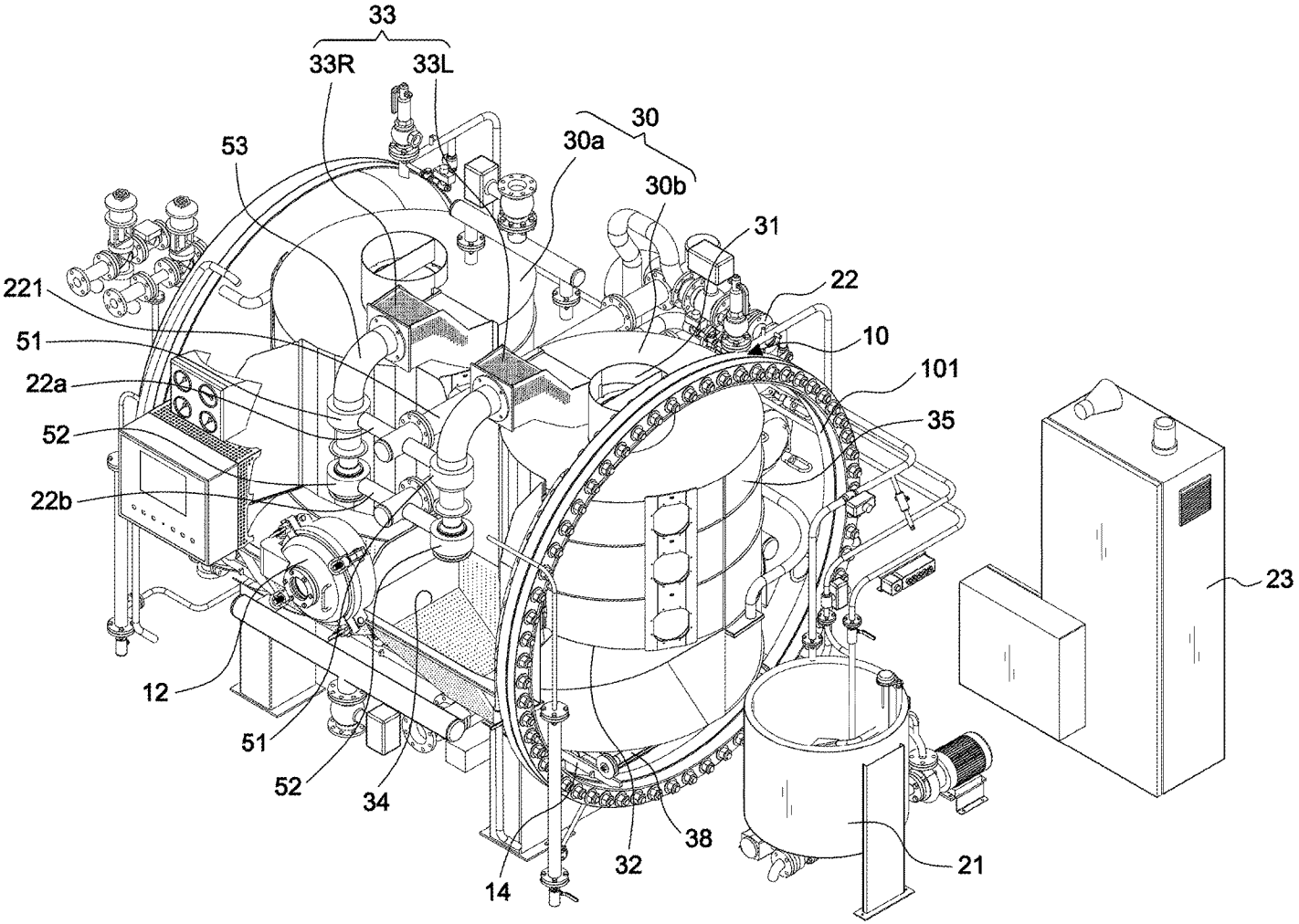
FIG. 3A is a perspective view of the present invention showing a barrel body with its casing removed.
Figure 3B:
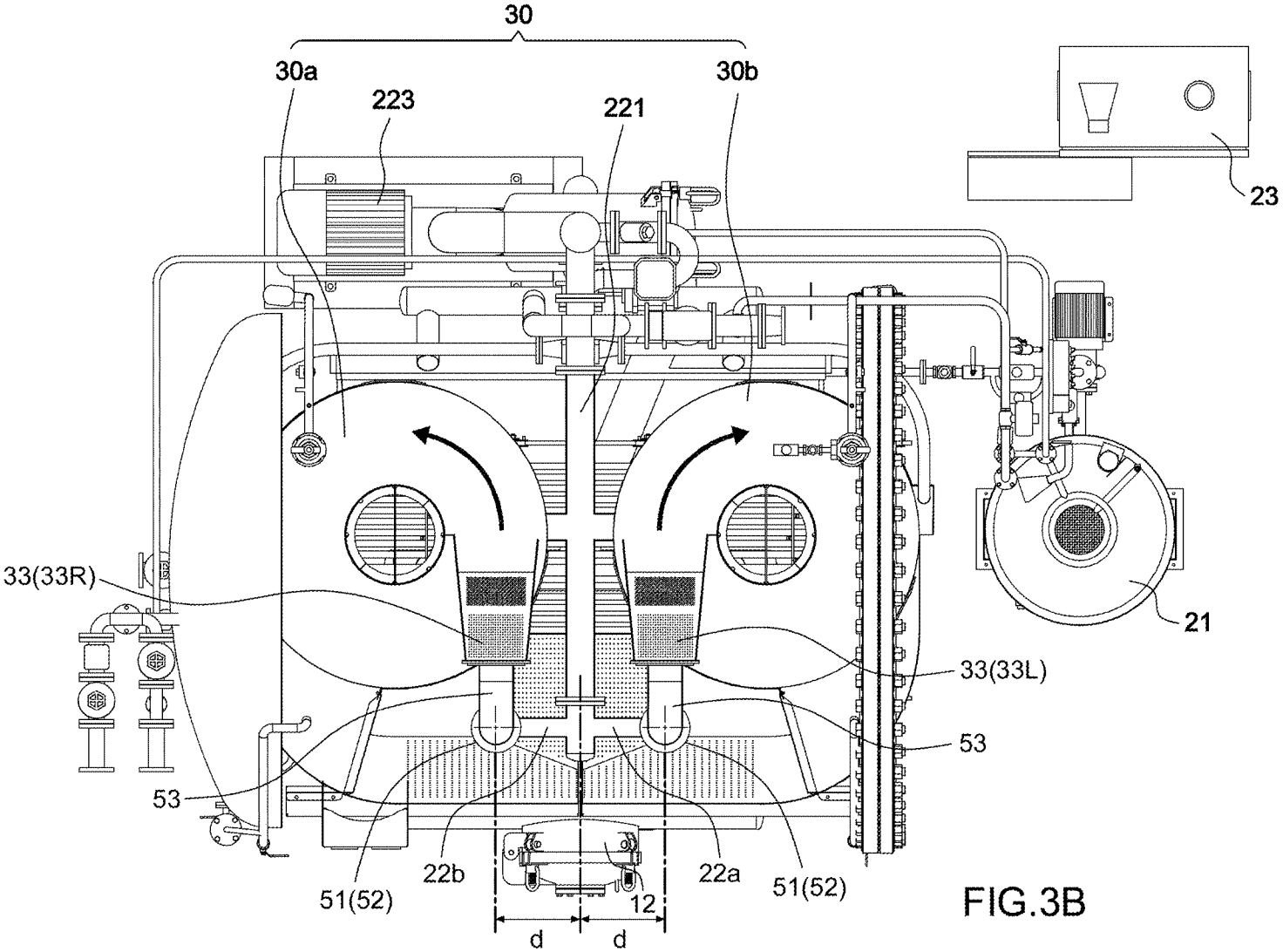
FIG. 3B is a top view of the present invention showing a barrel body with its casing removed.
Figure 3C:
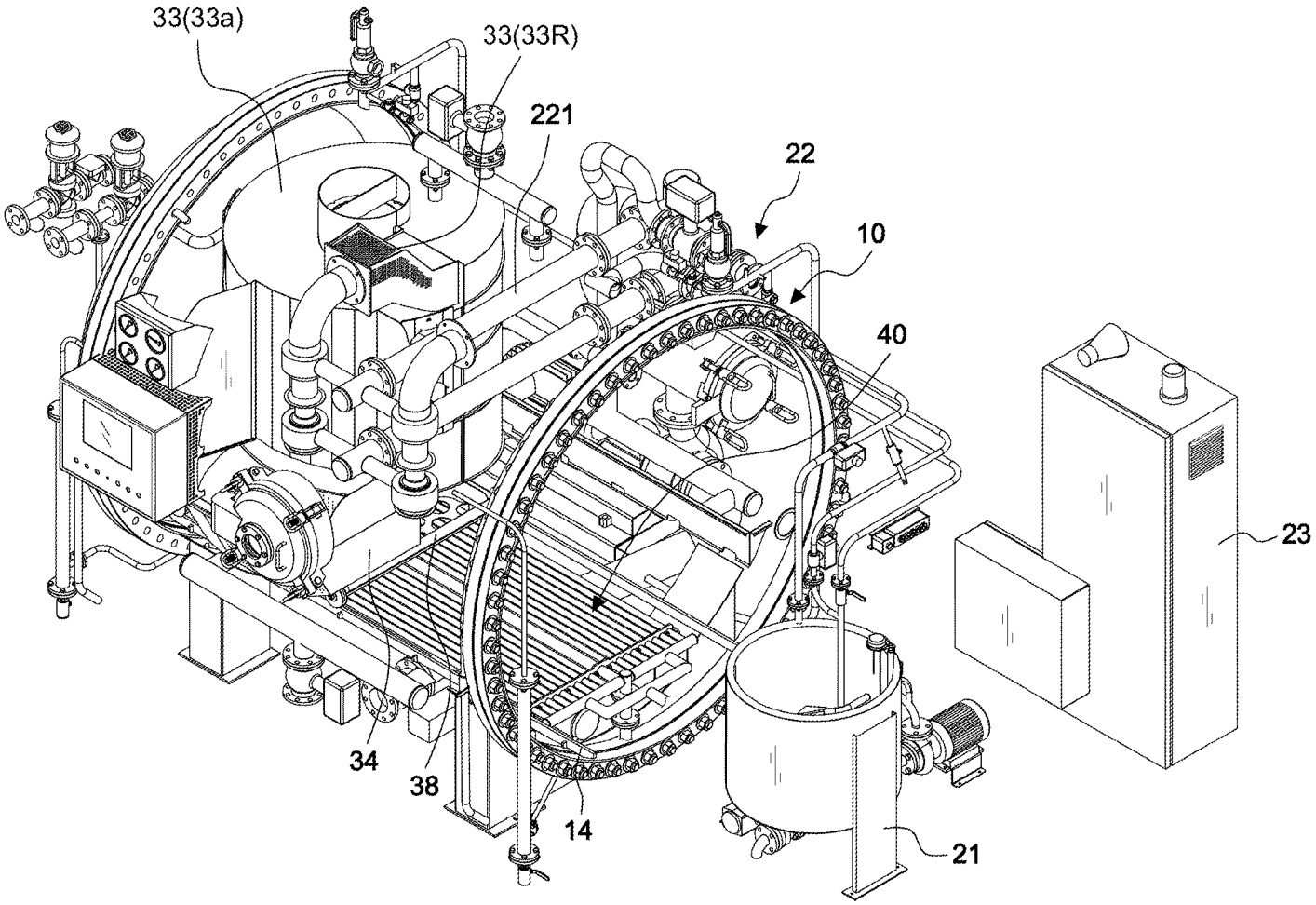
FIG. 3C is a perspective view of the present invention showing a barrel body having only one spiral fabric tank therein.
Figure 5:
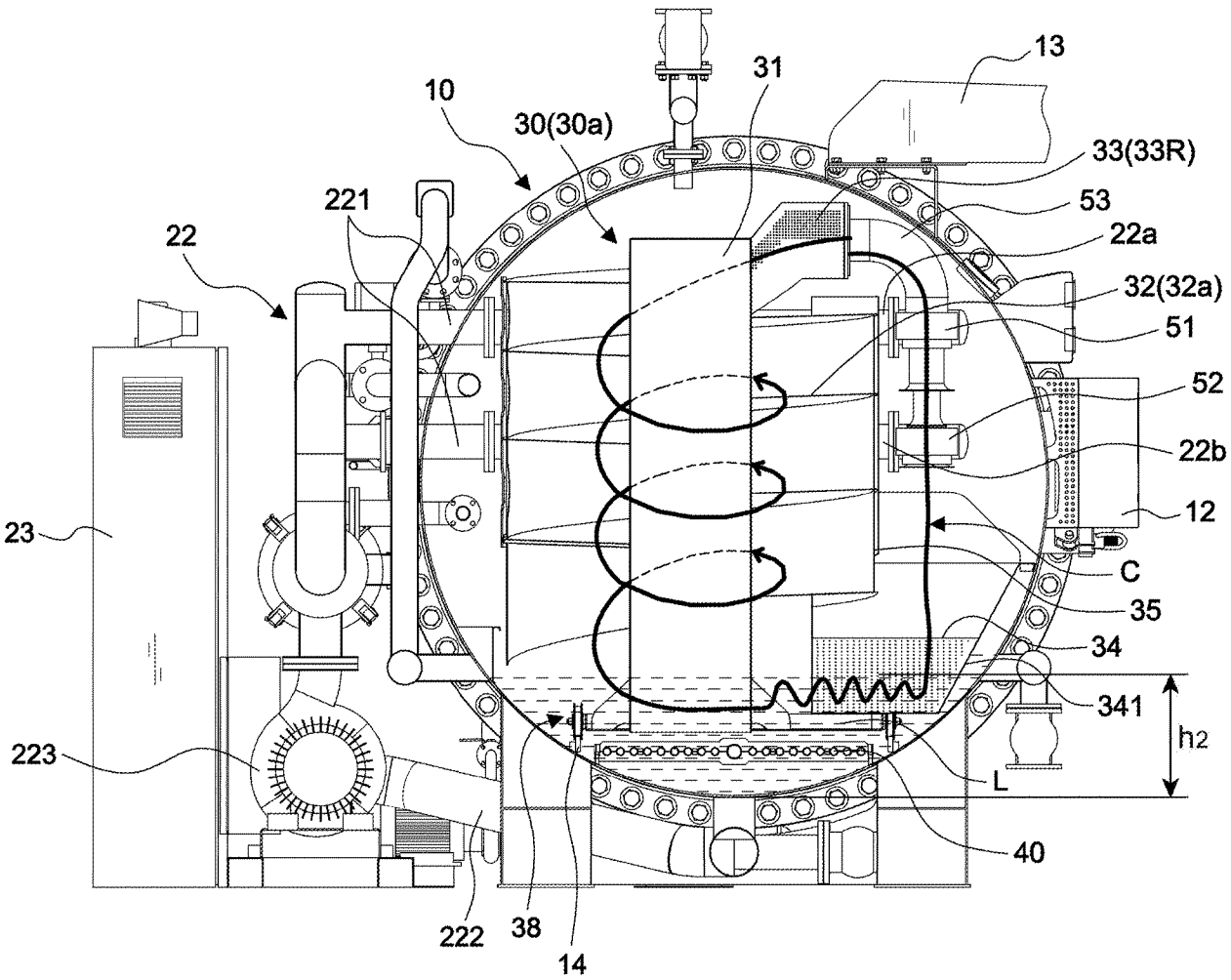
FIG. 5 is a cross-sectional view of the present invention.
Figure 10:
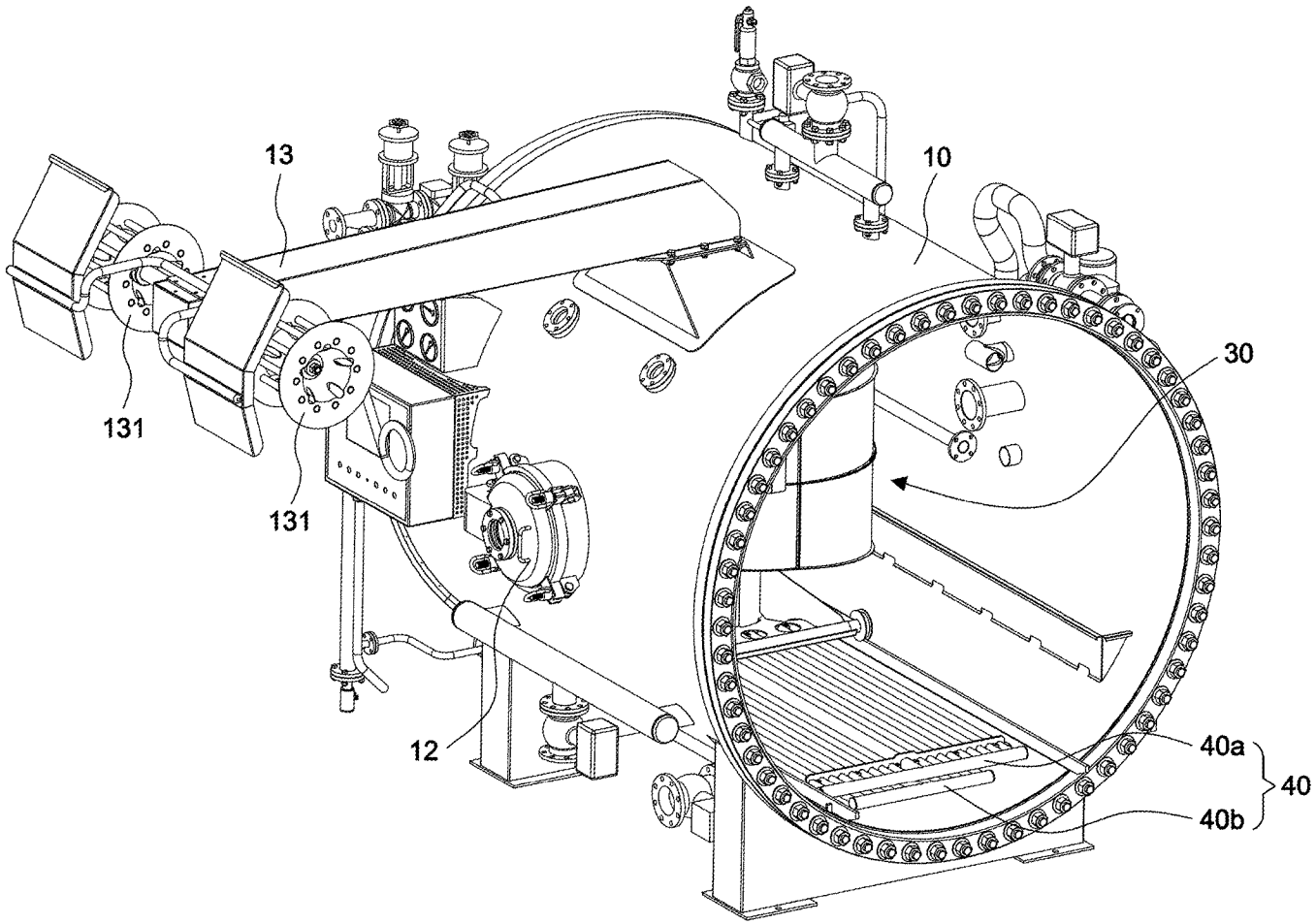
FIG. 10 is a perspective view of upper-layer and lower heat exchangers of the present invention.

With reference to FIGS. 2 to 3C for the structure of a dyeing machine of the present invention, the dyeing machine comprises: a barrel body 10, for accommodating a cloth and a dyeing solution for a fabric dyeing operation, and the barrel body 10 having a fabric inlet 12 formed at the front side of the barrel body 10, and a guiding rack 13 installed above the fabric inlet 12, and a runner 131 (or two runners 131 as shown in FIG. 10) installed at the outer end of the guiding rack 13 for driving cloth to feed/remove the cloth into/out from the fabric inlet 12 smoothly; the exterior of the barrel body 10 further having a dye injection mechanism 21 and a dyeing solution input mechanism 22, wherein and the dyeing solution input mechanism 22 has an outlet pipeline 221, an inlet pipeline 222 and a pump 223 (as shown in FIG. 5); a control mechanism 23 and a heat exchanger 40 (as shown in FIG. 3C), for performing a dipping and dyeing loop operation of the cloth in the barrel body 10 by the dyeing solution with the required heating or cooling step for the dyeing process. Since the input of the dyeing solution and the control operation are prior art and not claimed by the present invention, therefore they will not be described here.

The present invention is characterized in that the barrel body 10 is in a transverse form, and one of the left and right sides is an opening 101, and the periphery of a sealed cover 11 is locked and secured onto the opening 101 to seal the barrel body 10. In this preferred embodiment, the periphery of the sealed cover 11 is secured onto the opening 101 by a plurality of bolts 111. To disclose the internal structure of the barrel body 10 clearly, FIGS. 3A and 3B just show the casing of the barrel body 10 without the sealed cover 11.

With reference to FIGS. 3A to 5 for the structure of a spiral fabric tank 30 of the present invention, the structure comprises a first spiral fabric tank 30*a* and a second spiral fabric tank 30*b*, and the two spiral fabric tanks 30 (30*a*/30*b*) are arranged side by side with each other and installed in the barrel body 10, particularly on both sides of the fabric inlet 12 respectively, and the spiral fabric tank 30 comprises: a hollow tube 31, a spiral fabric sliding plate 32 installed at an outer edge of the hollow tube 31, a fabric guiding tube 33 installed at the upper front edge of the spiral fabric sliding plate 32, a receiving tank 34 installed at the lower front edge of the spiral fabric sliding plate 32, and a ring-shaped baffle 35 covered onto the outer edge of the spiral fabric sliding plate 32; wherein the receiving tank 34 has a plurality of through holes 341 formed on the peripheral wall of the receiving tank 34 and provided for flowing the dyeing solution L from the tank to the bottom of the barrel body 10 to facilitate the circulation of the dyeing solution L.

The present invention is also characterized in that the fabric guiding tubes 33 (33R/33L) of the first spiral fabric tank 30*a* and the second spiral fabric tank 30*b* as shown in FIGS. 3A and 3B are installed on both left and right sides respectively to form two fabric guiding tubes 33 (33R/33L) proximate to two adjacent sides and facing to the front, so as to become symmetrically with respect to the left and right sides, so that the spiral fabric sliding plates 32*a*, 32*b* of the first and second spiral fabric tanks 30*a*, 30*b* are coupled to the rear end of the two fabric guiding tubes 33R, 33 and configured to be spirally downward, wherein one of the spiral fabric tanks 30*a*, 30*b* is configured to be counterclockwise, and the other one is configured to be clockwise. In this preferred embodiment, the spiral of the first spiral fabric tank 30*a* is set to the counterclockwise direction, and the spiral of the second spiral fabric tank 30*b* is set to the clockwise direction.

The two first nozzle 51 are covered tubes 53 coupled to an inlet end of the fabric guiding tube 33 (33*a*/33*b*), and a first divided tube 22*a* is coupled to the first nozzle 51 and an outlet pipeline 221 of the dyeing solution input mechanism 22, so that the pressurized dyeing solution L delivers the cloth C in the receiving tank 34 to the fabric guiding tube 33 and spiral fabric sliding plate 32 through the first nozzle 51 and the curved tube 53, so that the cloth C can be dipped and dyed in the first and second spiral fabric tanks 30*a*/30*b* repeatedly. In this preferred embodiment, the dyeing machine further comprises two second nozzles 52 installed to the front of the first nozzle 51, and a second divided tube 22*b* is coupled to the second nozzle 52 and an outlet pipeline 221 of the dyeing solution input mechanism 22, so that the pressurized dyeing solution L guides the cloth in each receiving tank 34 into the first nozzle 51. The second nozzle 52 is provided for balancing the tension of the cloth C produced by the first nozzle 51.

Figure 4:
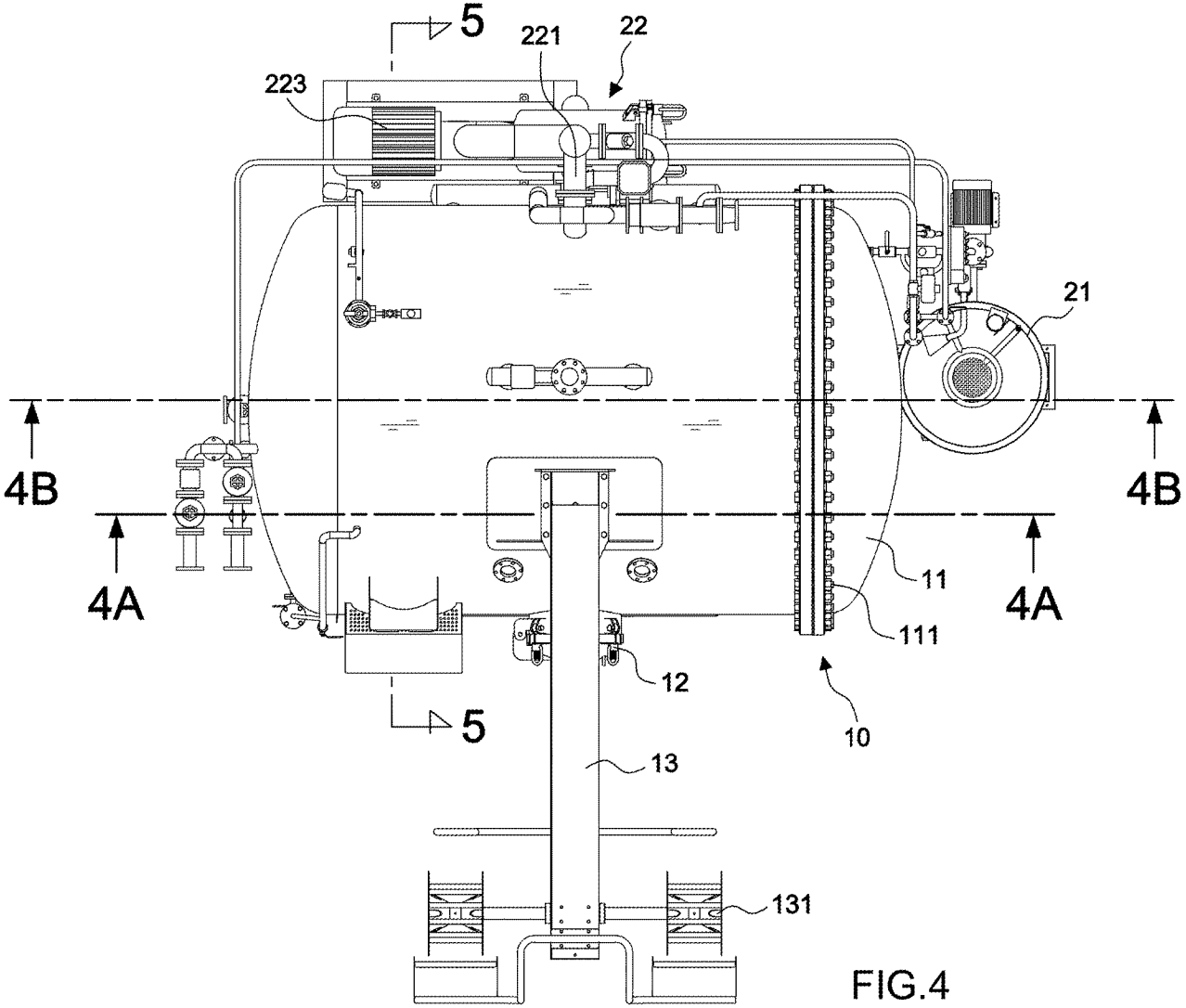
FIG. 4 is a top view of the present invention.
Figure 4A:
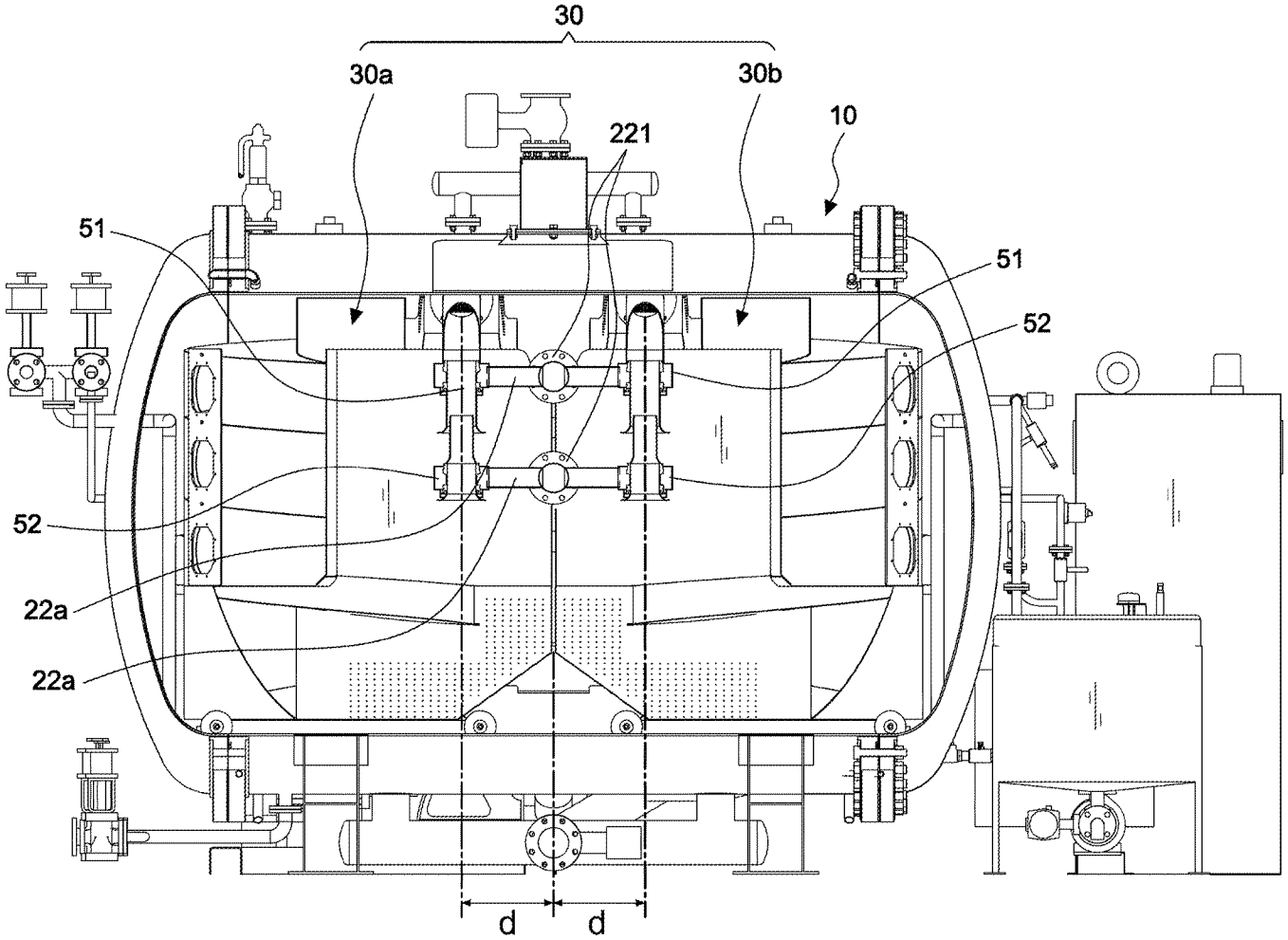
FIG. 4A is a cross-sectional view of Section 4A-4A of FIG. 4.
Figure 4B:
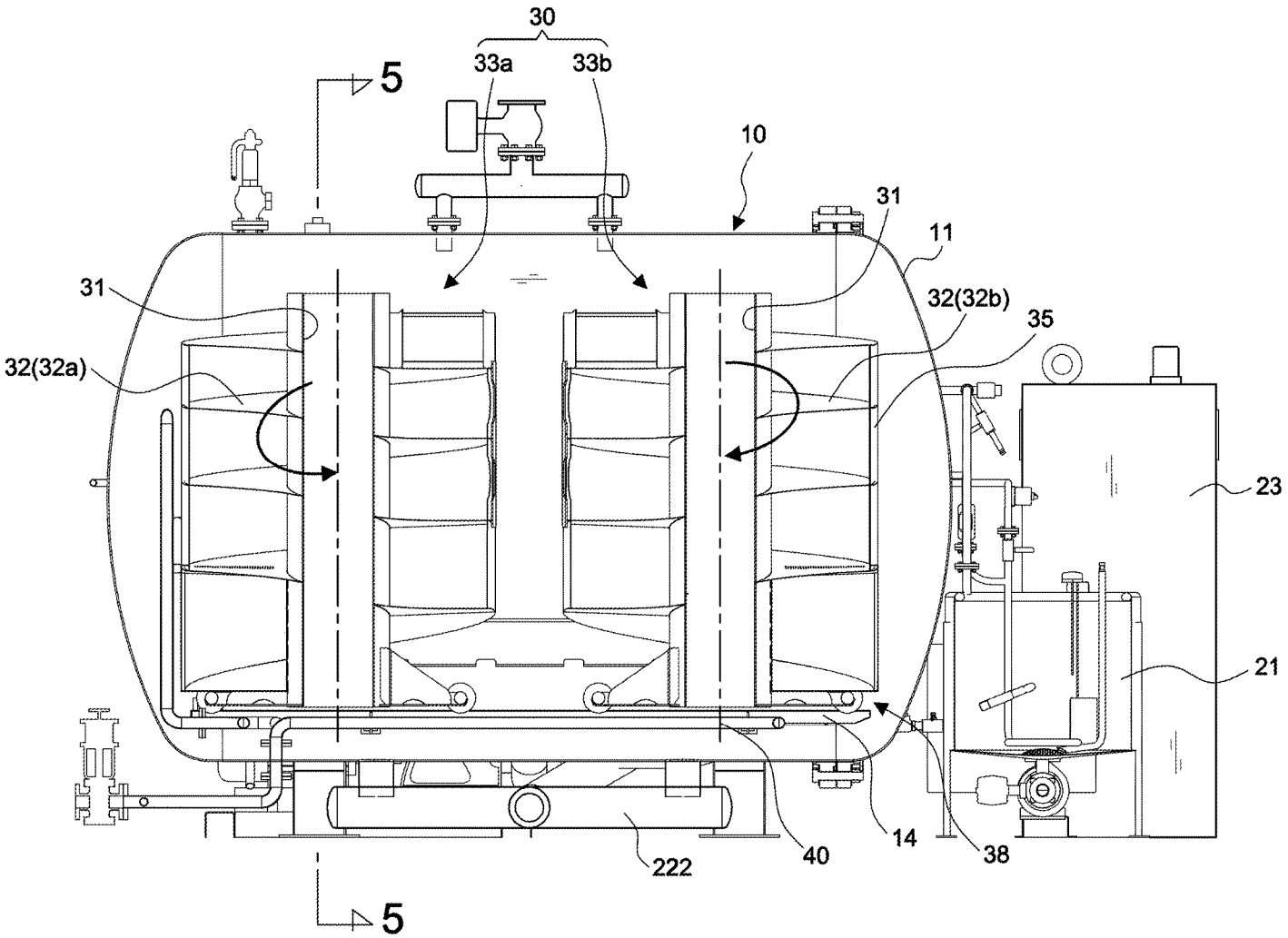
FIG. 4B is a cross-sectional view of Section 4B-4B of FIG. 4.

With reference to FIGS. 3A, 3B and 3C, the two fabric guiding tubes 33 (33R/33L) are configured to be symmetrical to each other, so that the distance from the first divided tube 22*a* to the left and right first nozzles of the outlet pipeline 221 of the dyeing solution input mechanism 22 and the distance (d) from the second divided tube 22*b* to the left and right second nozzles 52 are equal as shown in FIGS. 3B and 4A, so that the pressure at both left and right nozzles 51/52 is uniform and capable of preventing the quality of the fabric dyeing from being affected by the failure of synchronizing the pressure and speed of the nozzle. Since the two fabric guiding tubes 33 (33R/33L) are configured symmetrically with each other, therefore after the spiral fabric sliding plates 32*a*, 32*b* are coupled to the rear end of the two fabric guiding tubes 33R, 33L, they are configured to be spirally downward, and one of them is configured to be in a counterclockwise direction, and the other one is configured to be in a clockwise direction, so that the moment of inertia of the rotation of the two cloths in the spiral fabric tank 30 (30*a*/30*b*) is balanced, and this is the major technical characteristic of the present invention.

Figure 6:
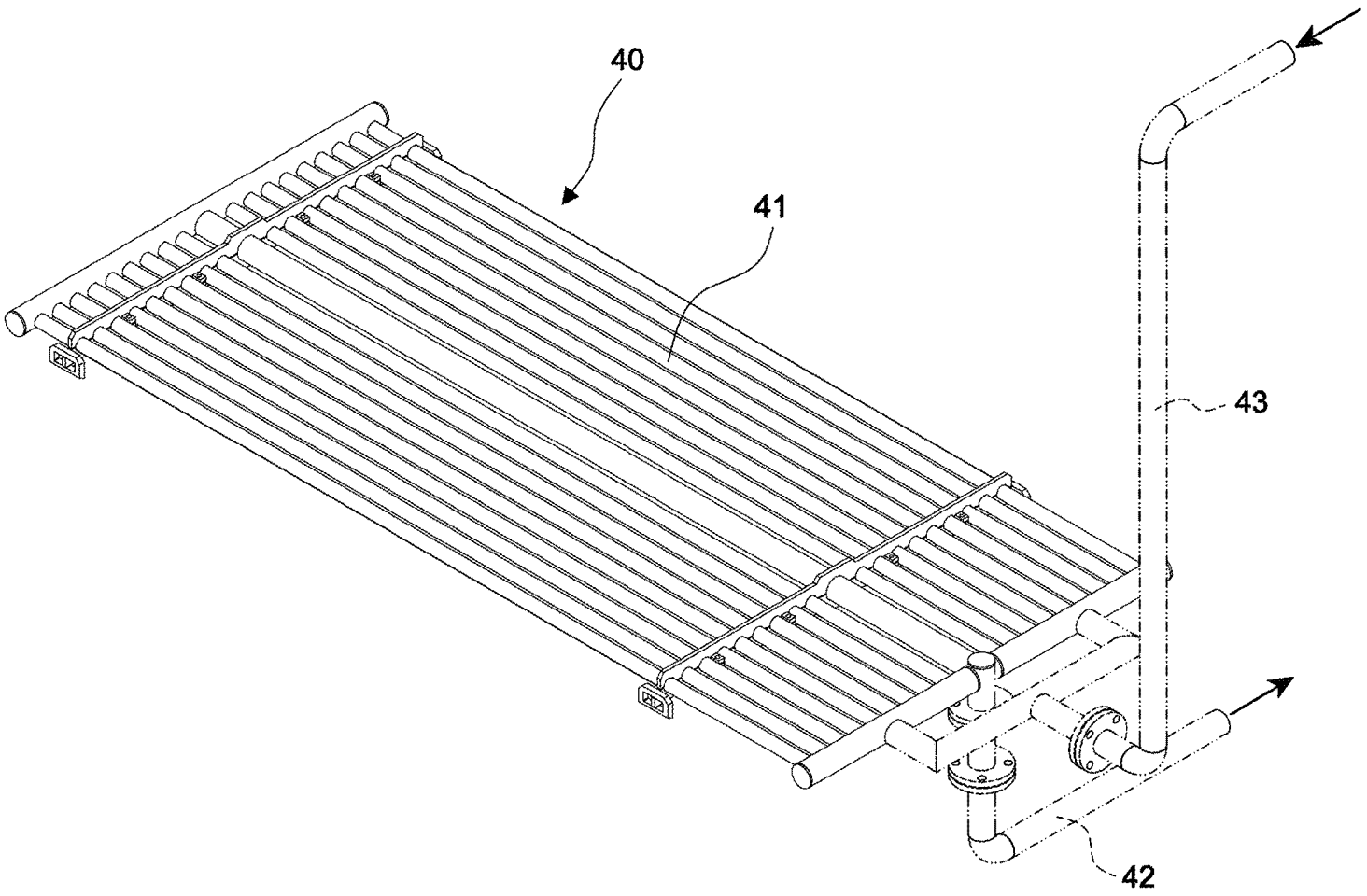
FIG. 6 is a schematic view of a heat exchanger of the present invention.
Figure 11:
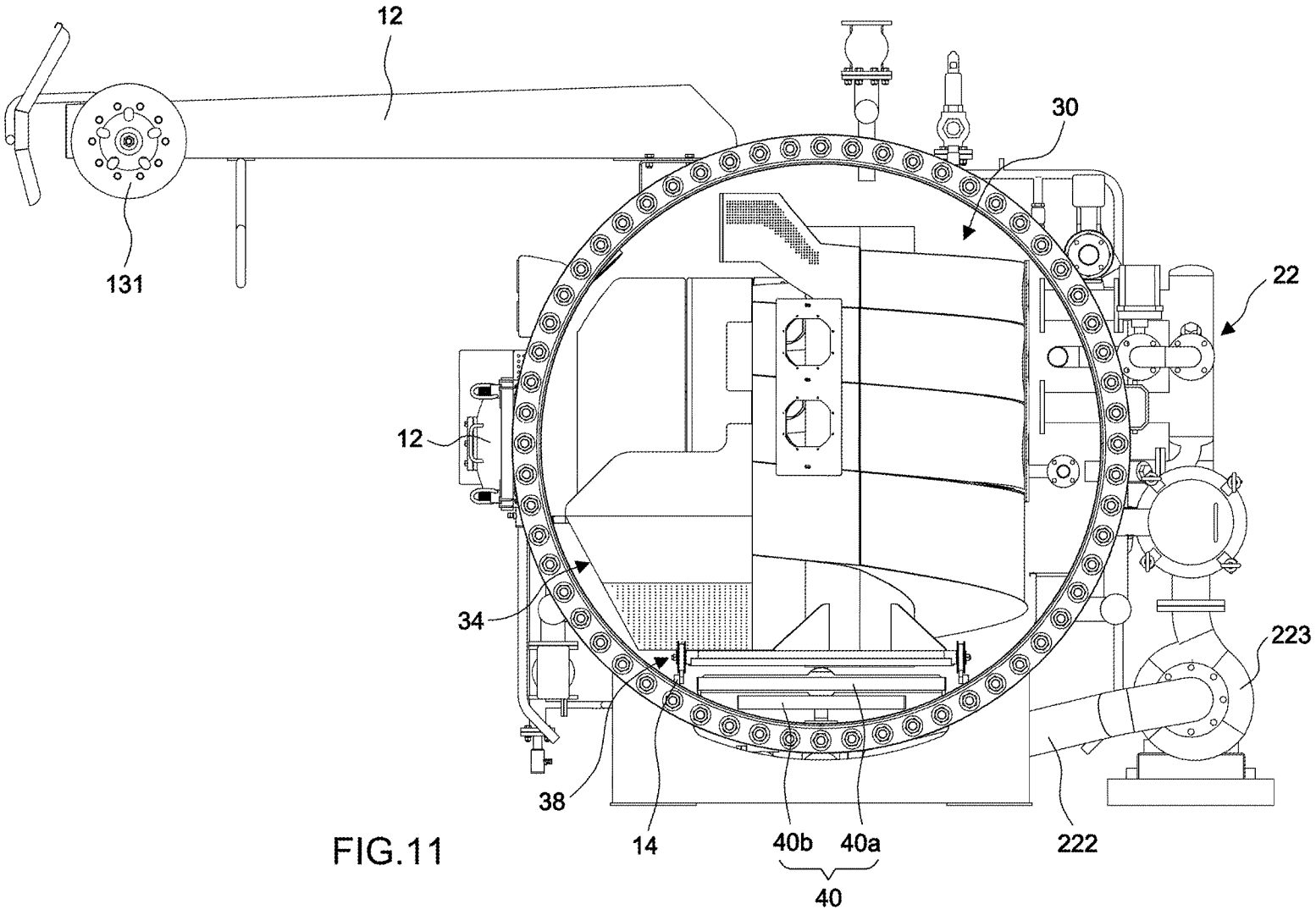
FIG. 11 is a side view of upper-layer and lower heat exchangers of the present invention.

In FIG. 3C, a heat exchanger 40 is installed under the first and second spiral fabric tanks 30*a*/30*b* for heating and cooling the bottom of the barrel body 10 and the dyeing solution L in the receiving tank 34. In FIG. 6, the heat exchanger 40 comprises a plurality of heat pipes 41, an inflow pipe 42, and an outflow pipe 43, wherein during the process of heating the dyeing solution L, steam is introduced from a remote end of the inflow pipe 42. During the process of cooling the dyeing solution L, cooling water is introduced from a remote end of the inflow pipe 42, and the dyeing solution L performs a heat exchange with a fluid (which is the steam or cooling water) at the outer edge and inner edge of the plurality of heat pipes 41 and then the fluid at the inner edge flows from are remote end of the outflow pipe 43. With reference to FIGS. 10 and 11 for a heat exchanger 40 of this preferred embodiment, the heat exchanger 40 comprises an upper-layer heat exchanger 40*a* and a lower-layer heat exchanger 40*b*, so that each of the upper-layer and lower-layer heat exchangers 40*a*, 40*b* is a circulation loop, and one of the upper-layer and lower-layer heat exchangers 40*a*, 40*b* performs a steam loop, and the other one of the upper-layer and lower-layer heat exchangers 40*a*, 40*b* performs a hot coal oil loop, and one of the upper-layer and lower-layer heat exchangers 40*a*, 40*b* is selectively turned on and used, or both of the upper-layer and lower-layer heat exchangers 40*a*, 40*b* are turned on and used. Therefore, steam or hot coal oil may be selected as a heat exchange medium according to the type and property of the dyeing solution L and the cloth C to achieve the best effect of the heat exchanger. The pipeline (such as the inflow pipe 42 and the outflow pipe 43) for delivering the steam of the upper-layer heat exchanger 40*a* or the hot coal oil of the lower-layer heat exchanger 40*b* are shown in FIG. 6 and will not be described.

Figure 7:
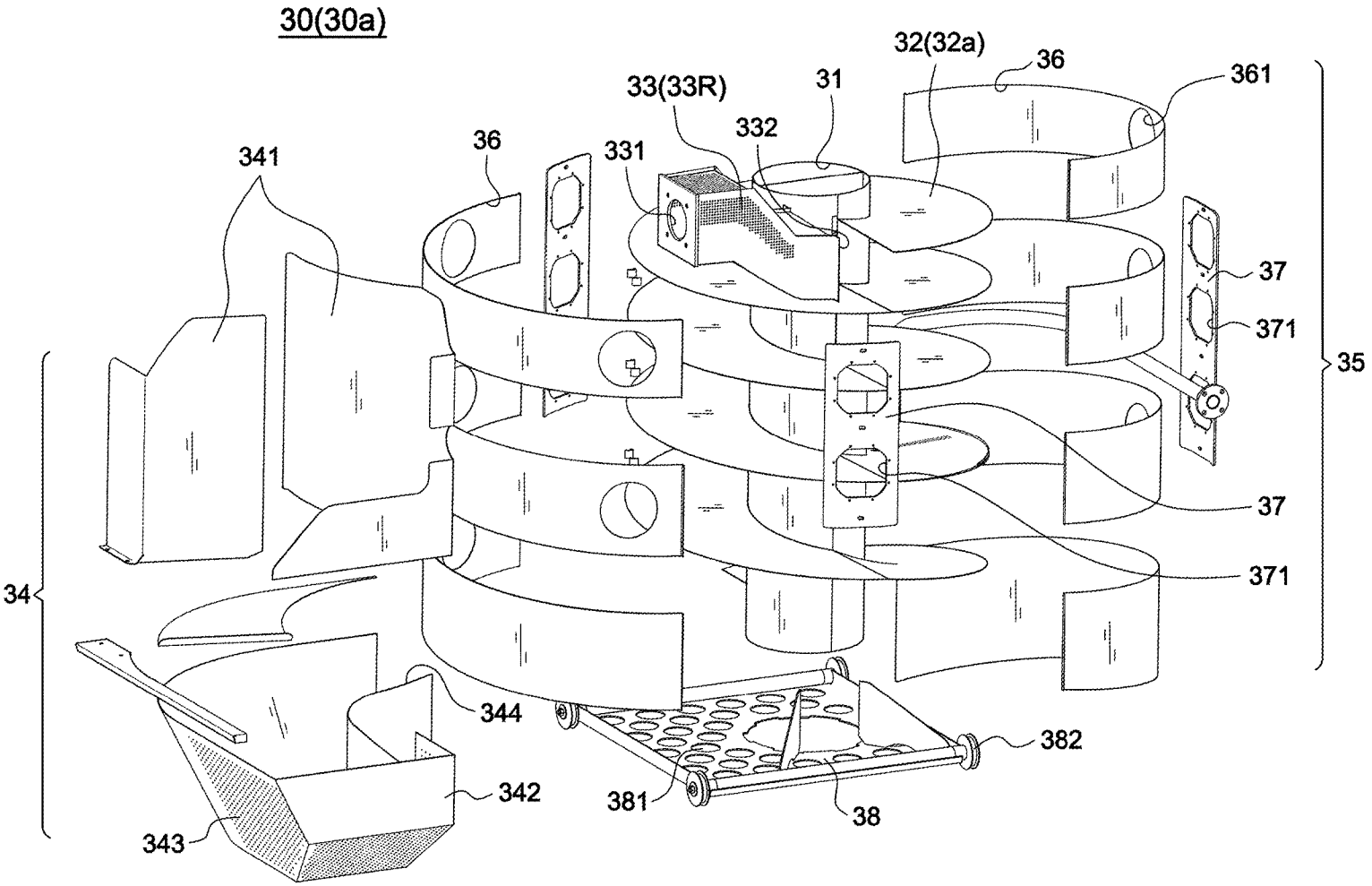
FIG. 7 is an exploded vim of a spiral fabric tank of the present invention.
Figure 8:
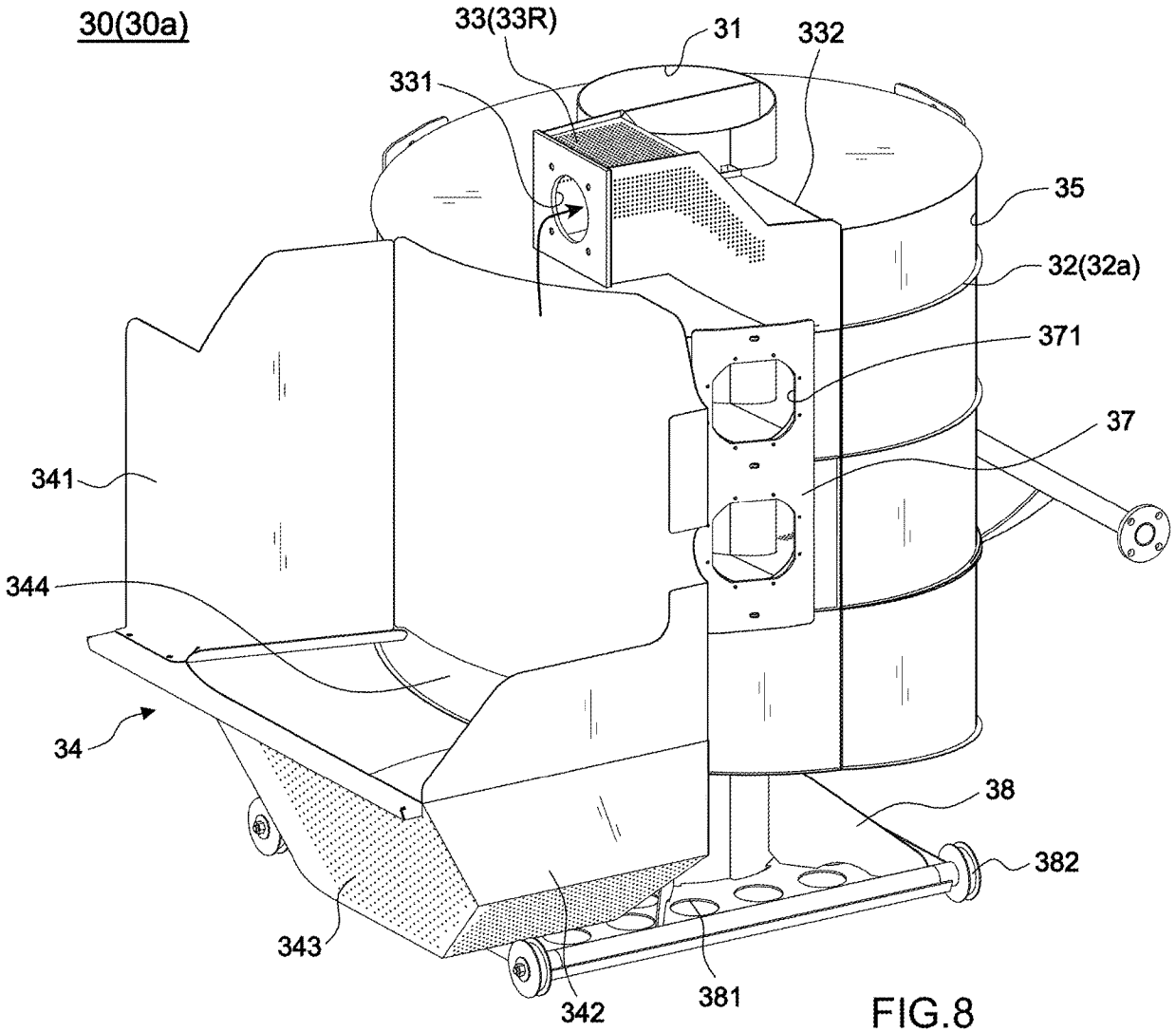
FIG. 8 is a perspective view of a spiral fabric tank of the present invention.

With reference to FIGS. 7 and 8 for the structure of a spiral fabric tank 30 of the present invention, the hollow tube 31 is a frame, and the spiral fabric sliding plate 32 is welded to the outer edge of the hollow tube 31, and the ring-shaped baffle 35 is formed by a plurality of semicircular stop plates 36 and four fixed plates 37, and the fixed plates 37 are configured to be 90° with respect to each other and welded onto the spiral fabric sliding plates 32, and the semicircular stop plates 36 are welded onto the fixed plates 37, so that the ring-shaped baffle 35 is covered onto the outer periphery of the spiral fabric sliding plate 32, so that the cloth C sliding on the spiral fabric sliding plate 32 is blocked by the ring-shaped baffle 35 and will not fall out from the spiral fabric tank 30. In addition, the fabric guiding tube 33 is installed to the upper front edge of the spiral fabric sliding plate 32, and the receiving tank 34 is installed to the lower front edge of the spiral fabric sliding plate 32, and the inlet end of the fabric guiding tube 33 has a fabric guiding opening 331, and an outlet end of the fabric guiding tube 33 has a fabric delivering opening 332, and the cloth C is entered from the fabric guiding opening 331 into the fabric guiding tube 33, and then guided from the fabric delivering opening 332 into the spiral fabric sliding plate 32. The upper half periphery of the receiving tank 34 has a side guard 341 for fixing onto the ring-shaped baffle 35, and the lower half periphery of the receiving tank 34 is a tank body 342 with a plurality of through holes 343 formed on the peripheral wall of the receiving tank 34 for facilitating the dyeing solution L to flow to the bottom of the barrel body 10, and the receiving tank 34 has a groove opening 344, so that the cloth on the spiral fabric sliding plate 32 can slide into the groove opening 344 and will be accumulated in the receiving tank 34. In addition, each fixed plate 37 has a plurality of first overflow holes 371, and each semicircular stop plate 36 has a plurality of second overflow holes 361, and the overflow holes 361, 371 are provided for flowing any saturated dyeing solution L of the cloth C passing through the spiral fabric sliding plate 32 to the outside of the spiral fabric tank 30. During the repair and maintenance of the spiral fabric tank 30, the first and second overflow holes 371/361 may act as the spraying holes of a cleaning liquid for cleaning the spiral fabric tank 30. Two carrier stages 38 are installed to the bottom edge of the barrel body 10, and the lower end of the hollow tube 31 of the spiral fabric tank 30 are welded to the top of the carrier stage 38, so that the first and second spiral fabric tanks 30*a*/30*b* can be fixed in the barrel body 10. Further, the stage top of the carrier stage 38 has a plurality of meshes 381 provided for flowing the dyeing solution L in the spiral fabric tank 30 to the bottom edge of the barrel body 10.

Figure 9:
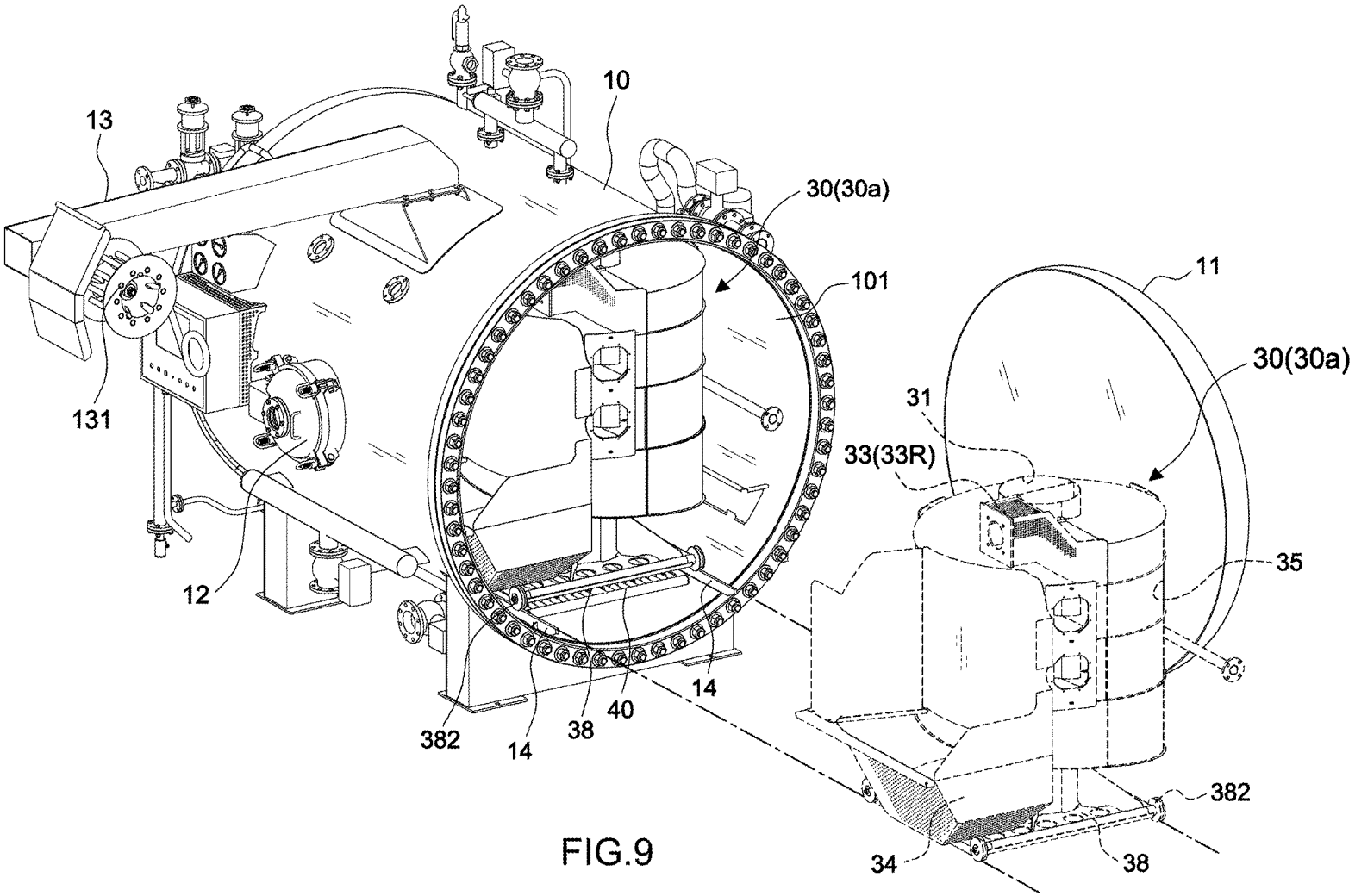
FIG. 9 is a schematic view of adjusting or repairing a spiral fabric tank of the present invention.

In FIG. 9, the carrier stage 38 of this preferred embodiment has four guiding wheels 382 installed at the corners of the carrier stage 38 respectively, and the barrel body 10 further has two rails 14 installed at the lower inner edge of the barrel body and configured to e corresponsive to the guiding wheels 382 respectively. If it is necessary to adjust, repair or maintain the spiral fabric tank 30 in the barrel body 10, users may open the sealed cover 11 and use the rail 14 to push the first and second spiral fabric tanks 30*a*/30*b* out from the barrel body 10 easily. FIG. 9 is a schematic view of pushing the first spiral fabric tank 30*a* out from the barrel body 10.

In the present invention, the first and second spiral fabric tanks 30*a*/30*b* in the barrel body 10 have the fabric guiding tube 33(33*a*/33*b*), the spiral fabric sliding plates 32 (32*a*/32*b*), and the receiving tank 34, so that the space for accommodating the cloth can be increased according to different dyeing requirements, and the cloth can be arranged smoothly during the dyeing process to prevent the dyeing machine from being jammed. In addition, the barrel body 10 has the first and second nozzles 51/52, so that the dyed cloth can be entered from the receiving tank 34 through the fabric guiding tube 33(33*a*/33*b*) into the spiral fabric sliding plate 32(32*a*/32*b*) for the repeated dipping and dyeing operation without requiring the installation of any fabric carrying roller. Therefore, the requirement for synchronizing the speed of the nozzle with the speed of the fabric carrying roller in order to maintain the quality and texture of the fabric dyeing no longer exists. The dyeing solution input mechanism 22 of the present invention can meet the requirement of providing the dyeing solution for two spiral fabric tanks 30(30*a*/30*b*) simultaneously, and an operator can monitor the dyeing operations of two cloths simultaneously. In FIG. 5, the level (h2) of the dyeing solution (L) is just up to the foot level of the barrel body 10 to sufficiently dip and dye the cloth C, so that the present invention can achieve a low bath ratio and the effects of saving energy, lowering equipment cost, and improving production efficiency. In addition, the spiral fabric tank 30 and the barrel body 10 of the present invention are independent modules, so that the volume of the receiving tank 34 and the length of the spiral fabric sliding plate 32 in the spiral fabric tank 30 can be adjusted according to the type of the cloth to achieve the effect of improving equipment performance.

What is claimed is:

1. A dyeing machine with symmetrical double spiral fabric tanks, comprising:

a barrel body, being in a transversal form, and one of the left and right sides being opened, and having a sealed cover with a periphery secured onto the opening to seal the barrel body, and the front side of the barrel body further having a fabric inlet;

first and second spiral fabric tanks, configured side by side with each other in the barrel body, and installed on both sides of the fabric inlet respectively, and each of the first and second spiral fabric tanks comprising: a hollow tube, a spiral fabric sliding plate installed at the outer periphery of the hollow tube, a ring-shaped baffle covered onto the outer periphery of the spiral fabric sliding plate, a fabric guiding tube installed at an upper front edge of the spiral fabric sliding plate, and a receiving tank installed at a lower front edge of the spiral fabric sliding plate, and having a plurality of through holes formed on the peripheral wall of the receiving tank, wherein one fabric guiding tubes of the first and second spiral fabric tanks is installed on the right side, and the other fabric guiding tube is installed on the left side, so as to form two fabric guiding tubes proximate to two adjacent sides and facing to the front, and substantially symmetrical with each other respect to the left and right sides each other, and the spiral fabric sliding plates of the first and second spiral fabric tanks are coupled to the rear end of the fabric guiding tube and configured to be in spirally downward form, and one of the first and second spiral fabric tanks is set to be counterclockwise, the other one is set to be clockwise;

two carrier stages, installed under the first and second spiral fabric tanks respectively, and each carrier stage having a plurality of meshes formed at a stage top of the carrier stage and four symmetrical four guiding wheels, and two parallel rails installed at the lower end of the inner edge of the barrel body and configured to be corresponsive to the guiding wheels respectively, so that the first and second spiral fabric tanks can be pushed out of the barrel body by the carrier stage for repair and maintenance;

a dyeing solution input mechanism and a dye injection mechanism for resupplying a dyeing solution, installed outside the barrel body, and the dyeing solution input mechanism having an outlet pipeline, an inlet pipeline and a pump;

at least one heat exchanger, installed under the carrier stage, for heating and cooling the dyeing solution in the barrel body;

two first nozzle, coupled to an inlet end of the fabric guiding tube, and coupled to an outlet pipeline of the dyeing solution input mechanism by a pipeline, so that the pressurized dyeing solution delivers the cloth in the receiving tank to the fabric guiding tube and the spiral fabric sliding plate, and the cloth is dipped and dyed in the first and second spiral fabric tanks repeatedly in a cycle; and a control mechanism, for controlling the heat exchanger for heating and cooling the dyeing solution in a dyeing process.

2. The dyeing machine with symmetrical double spiral fabric tanks according to claim 1, wherein the ring-shaped baffles of the first and second spiral fabric tanks are fixed onto at least two fixed plates by a plurality of semicircular stop plates respectively, and each fixed plate is fixed onto the spiral fabric sliding plate.

3. The dyeing machine with symmetrical double spiral fabric tanks according to claim 2, wherein each fixed plate has a plurality of first overflow holes formed thereon, and each semicircular stop plate has a plurality of second overflow holes.

4. The dyeing machine with symmetrical double spiral fabric tanks according to claim 1, further comprising a guiding rack, installed above the fabric inlet formed at the outer periphery of the barrel body, a runner installed at an outer end of the guiding rack, for feeding, guiding and outputting the cloth to be dyed in the first and second spiral fabric tanks.

5. The dyeing machine with symmetrical double spiral fabric tanks according to claim 1, further comprising two second nozzles disposed at the front of the first nozzle, for guiding the cloth in the receiving tank into the first nozzle.

6. The dyeing machine with symmetrical double spiral fabric tanks according to claim 1, wherein the heat exchanger includes an upper-layer heat exchanger and a lower-layer heat exchanger, and each of the upper-layer and lower-layer heat exchangers is a circulation loop, and one of the upper-layer and lower-layer heat exchangers acts as a hot steam loop, and the other one of the upper-layer and lower-layer heat exchangers acts as a hot coal oil loop, and one of the upper-layer and lower-layer heat exchangers is selectively turned on and used, or both of the upper-layer and lower-layer heat exchangers are turned on and used simultaneously.

* * * * *